US006644188B2

(12) United States Patent
Kolbe et al.

(10) Patent No.: US 6,644,188 B2
(45) Date of Patent: Nov. 11, 2003

(54) METHOD OF EXCHANGING A PRINTING CYLINDER SLEEVE AND PRINTING MACHINE FOR CARRYING OUT THE METHOD

(75) Inventors: Wilfried Kolbe, Gülzow (DE); Klaus Schirrich, Bielefeld (DE); Manfred Terstegen, Bielefeld (DE); Bodo Steinmeier, Bielefeld (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 36 days.

(21) Appl. No.: 10/038,779

(22) Filed: Jan. 2, 2002

(65) Prior Publication Data

US 2002/0108520 A1 Aug. 15, 2002

(30) Foreign Application Priority Data

Jan. 4, 2001 (EP) ..... 01100301

(51) Int. Cl.[7] ..... B41F 5/00; B41F 13/00; B41F 13/10

(52) U.S. Cl. ..... 101/375; 101/216; 101/378; 101/382.1; 101/388; 101/475; 101/479; 101/485

(58) Field of Search ..... 101/375, 378, 101/382.1, 388, 475, 479, 485, 216

(56) References Cited

U.S. PATENT DOCUMENTS 5,370,047 A 12/1994 Compton
RE35,646 E * 11/1997 Guaraldi et al. ..... 101/216
5,692,442 A 12/1997 Leanna
5,832,829 A * 11/1998 Kolbe et al. ..... 101/352.01
5,906,162 A * 5/1999 Kolbe et al. ..... 101/352.01
6,125,752 A * 10/2000 Freddp et al. ..... 101/182
6,142,073 A 11/2000 Zeman et al.
6,502,509 B2 * 1/2003 Gottling et al. ..... 101/248

FOREIGN PATENT DOCUMENTS

EP 0812681 12/1997
EP 0955161 11/1999
EP 1090754 4/2001

OTHER PUBLICATIONS

"Flexo+Tief–Druck," a G&K TechMedia Publication, Mar. 2000, pp. 148–149.

* cited by examiner

*Primary Examiner*—Andrew H. Hirshfeld
*Assistant Examiner*—Marvin P. Crenshaw
(74) *Attorney, Agent, or Firm*—Richard M. Goldberg

(57) ABSTRACT

A method of exchanging a printing cylinder sleeve in a printing machine, which printing machine comprises a central cylinder and a plurality of ink units adapted to be adjusted against the central cylinder, each ink unit comprising a plate cylinder having a printing cylinder sleeve mounted on a mandrel, and a detachable bearing for supporting the mandrel, the method comprising the following steps, which are performed while the printing machine is running:

moving the plate cylinder away from the central cylinder to such an extent that a space formed between the plate cylinder and the central cylinder becomes large enough for gripping the printing cylinder sleeve, detaching the bearing, and withdrawing the printing cylinder sleeve axially from the mandrel.

6 Claims, 2 Drawing Sheets

METHOD OF EXCHANGING A PRINTING CYLINDER SLEEVE AND PRINTING MACHINE FOR CARRYING OUT THE METHOD

BACKGROUND OF THE INVENTION

The invention relates to a method of exchanging a printing cylinder sleeve in a printing machine which has a central cylinder and a plurality of ink units that are arranged to be adjusted to the central cylinder and each comprise a plate cylinder having a printing cylinder sleeve mounted on a mandrel, in which method the plate cylinder is moved away from the central cylinder and the printing cylinder sleeve is axially withdrawn from the mandrel after a bearing has been detached.

U.S. Pat. No. 5,832,829 (EP-A-0 812 681) discloses a flexographic printing machine having a plurality of ink units arranged at the periphery of a central cylinder, wherein the plate cylinder of each ink unit has a printing cylinder sleeve that is exchangeably mounted on a mandrel which is fixed in the machine frame. When the printing cylinder sleeve has to be exchanged, in order to, for example, prepare the machine for another print job, the plate cylinder is moved away from the periphery of the central cylinder, and, on the operating side of the printing machine, a bearing for the plate cylinder is detached and removed, for example by being shifted aside, so that the printing cylinder sleeve can axially be withdrawn from the mandrel. The mandrel is supported in a cantilever fashion on the opposing side of the printing machine and remains in the machine frame throughout the exchange process.

The printing cylinder sleeve may be a printing sleeve, on which the printing plates or blocks are mounted, or an intermediate sleeve which itself carries on its outer periphery a sleeve with the blocks mounted thereon.

In the paper "Flexo+Tief-Druck", 3-2000, May 2000, pages 148 and 149, a printing machine of the assignee has been described, wherein printing sleeves and intermediate sleeves with varying diameters may be clamped on the mandrel. The intermediate sleeve can be clamped on the mandrel by means of an hydraulic system. The sleeves are either thrust onto the intermediate sleeve or directly onto the mandrel, depending on their diameter. For facilitating the exchange of the sleeve, a compressed air system is provided, whereby compressed air is radially blown out of the mandrel and out of the intermediate sleeve, as the case may be, so that the printing sleeve may be slid on air cushion to be withdrawn from the mandrel or the intermediate sleeve by hand with low frictional resistance.

By utilizing a printing cylinder sleeve made of a carbon fiber compound material, a weight reduction can be achieved, which facilitates the handling of the printing cylinder sleeve and at the same time reduces the load on the mandrel that is cantilevered in the machine frame.

Assignee's EP-A-1 090 754 describes an apparatus which facilitates the manual exchange of the printing cylinder sleeve by providing, on the side opposite to the operating side of the machine, an ejector by which the printing cylinder sleeve to be exchanged can be ejected to some extent towards the operating side, so that it can more readily be gripped and withdrawn completely. When a new printing cylinder sleeve has been thrust onto the mandrel, it can be gripped by a claw of the ejector and can be drawn into the final position.

In spite of these measures for facilitating the handling, the exchange of the printing cylinder sleeves, when the machine is prepared for another print job, is still a relatively time-consuming operation which causes long production stops of the printing machine.

SUMMARY OF THE INVENTION

It is an object of the invention to provide a method by which, at least in some cases, the time of the production stop, when the printing machine is prepared for another job, can be shortened.

According to the invention, this object is achieved by the feature that the exchange of the printing cylinder sleeve is performed while the printing machine is running, and the plate cylinder is moved away from the central cylinder to such an extent that a space, which permits to safely grip the printing cylinder sleeve, is formed between the printing cylinder sleeve and the rotating central cylinder.

This method permits to shorten the time of a production stop in all those cases in which not all print units of the machine have been used for the previous job.

In this case, it is possible to exchange the printing cylinder sleeves of the non-used ink units before the running job has come to an end. Thus, the printing machine can be converted completely or partly for the print job to be executed next, before the running job is completed, so that the times of standstill can be reduced considerably. If, for example, in a printing machine having six ink units, two print jobs have to be executed one after the other, and only three colors are used in each job, then the three ink units which are not needed for the first job can already be converted for the next job, so that no time is needed any longer for exchanging the printing cylinder sleeves between the end of the first job and the beginning of the second job.

In most conventional printing machines, the plate cylinder is disposed at only a short distance from the peripheral surface of the central cylinder, even when the plate cylinder has been moved away from the central cylinder. Since the central cylinder rotates at high speed, there is a risk of damages or injuries when the printing cylinder sleeve is exchanged while the machine is running and when the printing cylinder sleeve or the equipment of handling the same or the hand of the operator, who exchanges the printing cylinder sleeves, touches the rotating central cylinder. This is why, according to the invention, the plate cylinder is moved so far away from the central cylinder that a sufficient safety space is formed between the printing cylinder sleeve and the periphery of the central cylinder. If no additional safety measures are provided, this space should be at least 120 mm. This implies a construction of the printing machine which permits to displace the plate cylinder far enough from the central cylinder.

The invention further provides a printing machine in which a safeguard is provided at the periphery of the central cylinder at the end thereof facing towards the operating side of the machine. This permits to safely exchange the printing cylinder sleeve, while the printing machine is running, even in cases in which, for constructional reasons, a safety distance of 120 mm or more between the plate cylinder and the central cylinder cannot be provided.

In a specific embodiment, the safeguard is arranged movably, and it is brought into the operative position only when the plate cylinder has been moved away from the central cylinder. In this case, the safeguard may have such a construction that, in its operative position, it projects into the space between the plate cylinder and the central cylinder and thereby shields the peripheral surface of the rotating central cylinder partly or completely.

DESCRIPTION OF A PREFERRED EMBODIMENT

An embodiment example of the invention will now be explained in conjunction with the drawings, in which.

Figure 1:
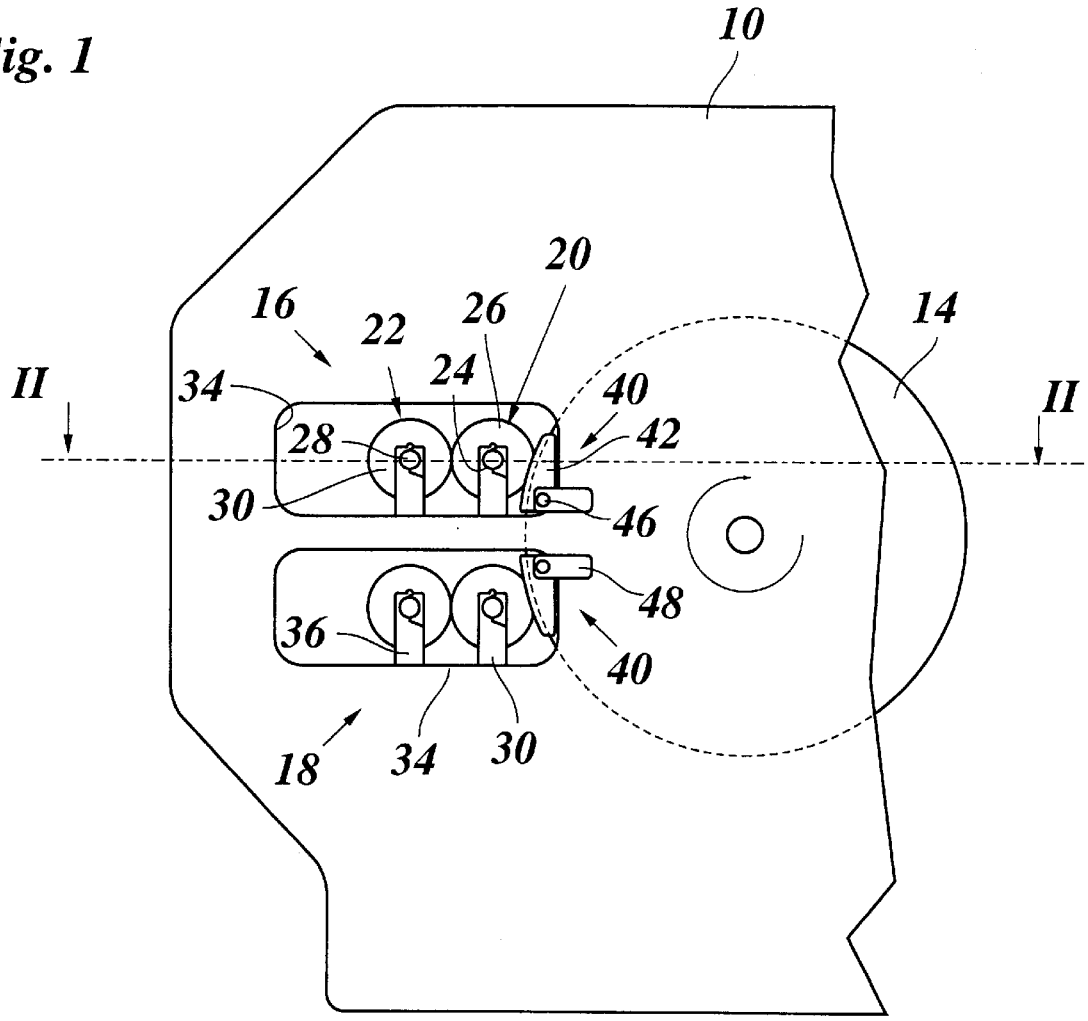
FIG. 1 is a schematic view of a part of a printing machine that is suitable for carrying out the method according to the invention.
Figure 2:
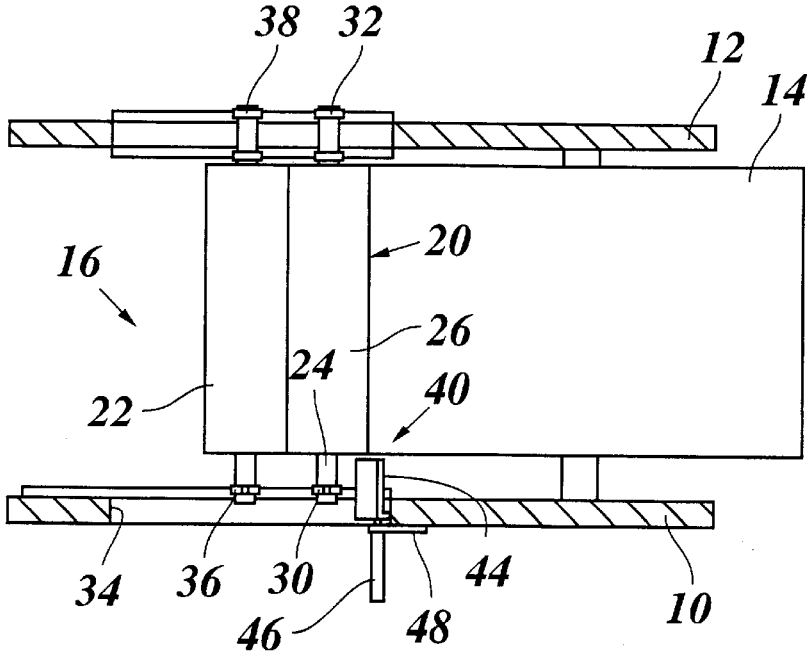
FIG. 2 is a sectional view taken along the line II—II in FIG. 1.

The printing machine shown in FIGS. 1 and 2 has a frame comprising side members 10, 12 and a central cylinder 14 journaled between the side members and adapted to be driven for rotation. A plurality of ink units, of which only two ink units 16, 18 are shown in the drawing, are arranged around the periphery of the central cylinder 14. Each ink unit has a plate cylinder 20 adapted to be adjusted against the central cylinder 14, and an anilox roller 22 adapted to be adjusted against the plate cylinder. In operation, the printing material (not shown) is looped over the periphery of the central cylinder 14, so that it passes through the nips which the central cylinder 14 forms with each of the plate cylinders 20. The anilox roller 22 is inked by means of a chamber-type doctor blade that has not been shown, and transfers ink onto the blocks that have been mounted on the plate cylinder 20, so that the printing material passing through the nip is printed with ink.

When the printing machine has to be converted for another print job, at least the block-carrying plate cylinders 20 of the ink units being used have to be exchanged. This may involve also a change of the diameter of the plate cylinder, if another printing length is required for the new print job. Frequently, it will also be necessary to exchange the anilox roller 22, in order to adapt the ink transfer properties of this anilox roller to the respective print job and the ink used therefor.

The plate cylinder 20 is made up of at least two parts and comprises a mandrel 24 that is rotatably supported in the machine frame, and a printing cylinder sleeve 26 that is detachably clamped onto the mandrel and has the blocks mounted on its outer periphery. Similarly, the anilox roller 22 also comprises a mandrel 28 and an exchangeable sleeve 30.

The mandrel 24 of the plate cylinder 20 of each ink unit is journaled in bearing blocks 30, 32 that are slidably guided in the side members 10, 12, so that the plate cylinder 20 may be adjusted against the central cylinder 14 and may be moved away from the latter. The side member 10 on the operating side of the printing machine has, for each ink unit 16, 18, a window 34 through which the plate cylinder 20 and the anilox roller 22 of the respective ink unit are accessible. The bearing block 30 guided on this side member 10 forms a hinged bearing which may be detached from the mandrel 24. On the opposite side, at the side member 12, the bearing block 32 forms a tilt-stable bearing by which the mandrel 24 can be held in cantilever fashion when the hinged bearing on the operating side has been detached and removed. The mandrel 28 of the anilox roller 22 is journaled in bearing blocks 36, 38 in an analogous way.

For each ink unit, the side member 10 is provided with a safeguard 40 which is disposed in the corresponding window 34. This safeguard 40 has a front plate 42 which shields the part of the end face of the central cylinder 14 lying behind the window 34. A shield plate 44 (FIG. 2) which projects at right angles from the front plate 42 is bent so as to follow the peripheral surface of the central cylinder 14 with little radial spacing. An adjusting cylinder 46, a pneumatic cylinder for example, is secured at the side member 10 by means of a base plate 48 and permits to adjust the safeguard 40 in the direction in parallel with the axis of the central cylinder 14. In the condition shown in FIG. 2, the safeguard 40 is withdrawn into the window 34, so that the shield plate 44 is disposed outside of the nip formed between the printing cylinder sleeve 26 and the central cylinder 14.

In this condition, the ink unit 16 in consideration can be used for printing. The same applies for the ink unit 18.

Figure 3:
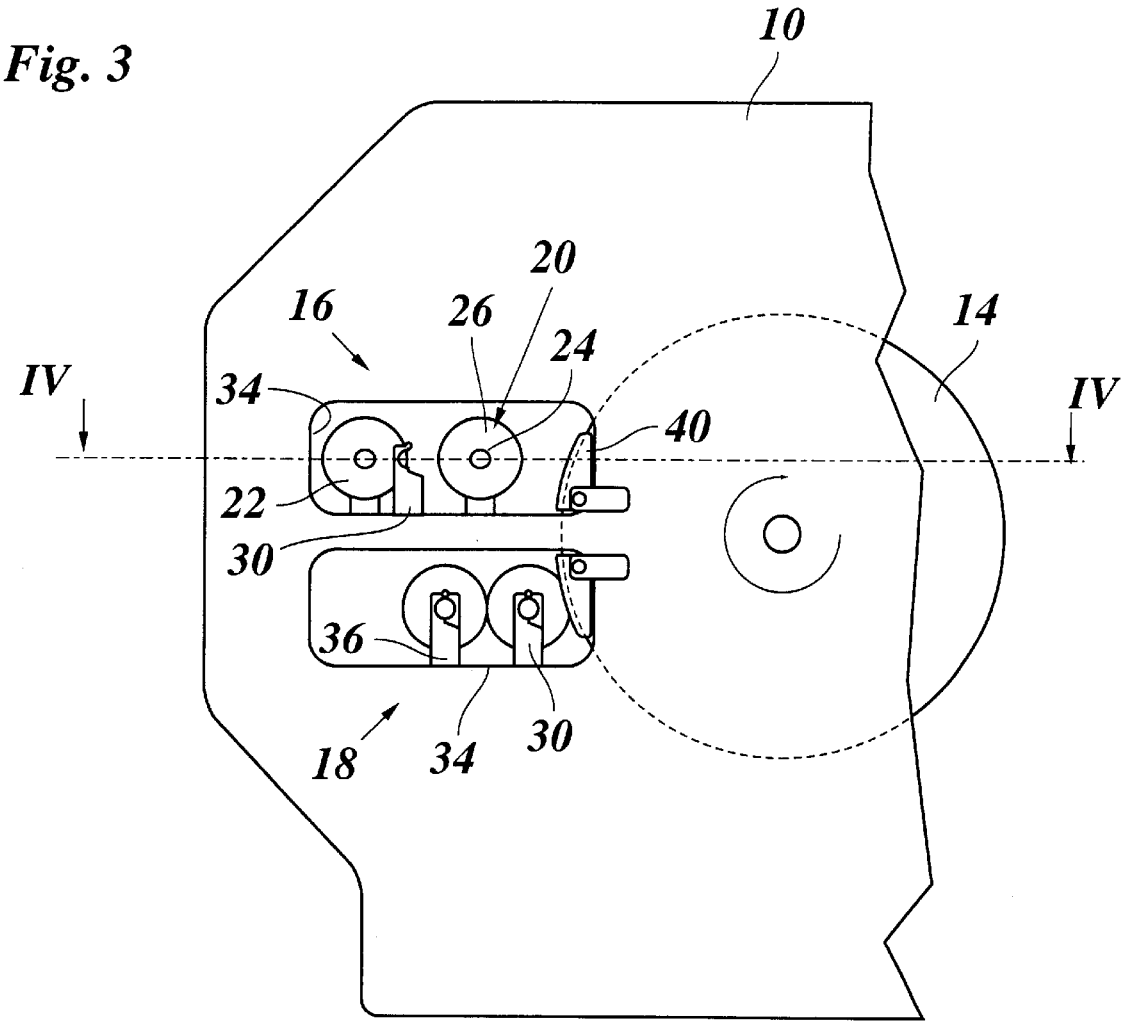
FIG. 3 is a view corresponding to FIG. 1, illustrating the condition of the printing machine during the exchange of a printing cylinder sleeve.

As an example, it shall now be assumed that, for the running print job, only the ink unit 18 is needed, whereas the ink unit 16 is idle. Under these circumstances, it is possible to convert the ink unit 16 already while the current job is still being processed, i.e. while the machine is running. To this end, the anilox roller 22 and the plate cylinder 20 are shifted to the position shown in FIG. 3. Then, a space of, for example, 120 mm is formed between the peripheral surface of the printing cylinder sleeve 26 and the peripheral surface of the central cylinder 14. Likewise, there is a certain space between the periphery of the anilox roller 22 and the printing cylinder sleeve 26. In order to prepare for the exchange of cylinders, the hinged bearings of the bearing blocks 30 and 36 are detached, and the bearing blocks 30, 36 are moved aside. The plate cylinder 20 is then held at its mandrel 24 alone by the bearing block 32 in a freely projecting cantilever fashion, and the end face of the printing cylinder sleeve 26 is freely accessible in the window 34 on the operating side.

Figure 4:
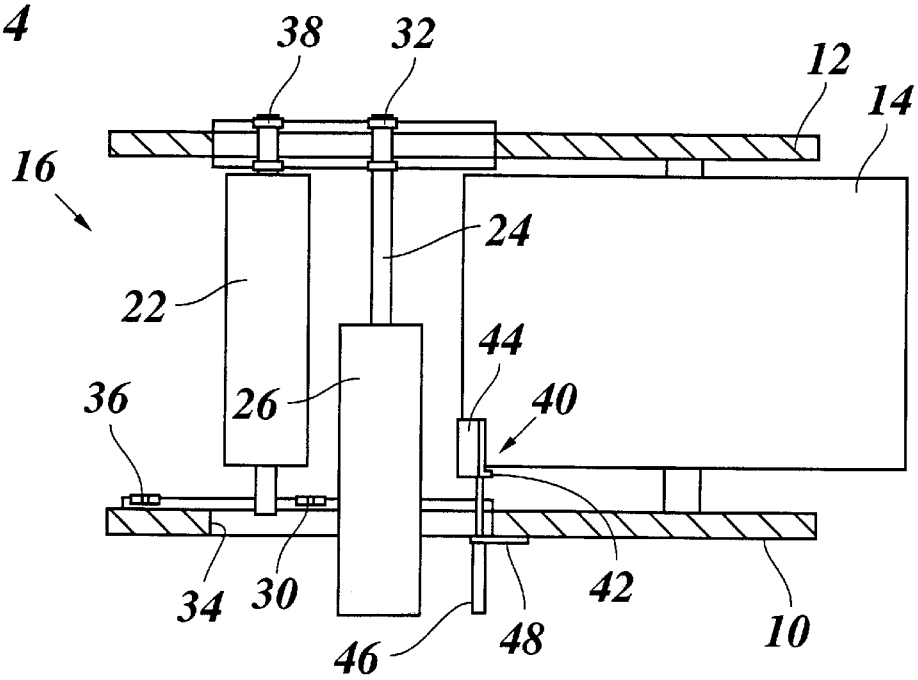
FIG. 4 is a sectional view taken along the line IV—IV in FIG. 3.

By means of the adjusting cylinder 46, the safeguard 40 is extended into the position shown in FIG. 4, in which the end plate 42 is disposed closely in front of the end face of the central cylinder 14 and the shield plate 44 shields the peripheral portion of the central cylinder 14 adjacent to the window 34. Even though the central cylinder 14 rotates at high speed, the operator may, without any risk, grip into the space between the central cylinder and the plate cylinder, in order to withdraw the cylinder sleeve 26 axially from the mandrel 24, as is shown in FIG. 4.

Likewise, a new printing cylinder sleeve 26 can be thrust onto the mandrel 24, again while the machine is running. For facilitating the exchange process, there may be provided an ejector system of the type disclosed in EP-A-1 090 754.

When the new printing cylinder sleeve 26 has fixedly been clamped onto the mandrel 24, for example by means of an hydraulic system, the bearing block 30 is returned into the position in which it supports the free end of the mandrel 24, and the hinged bearing is closed. Then, the bearing block 30 is in a position which enables also the exchange of the sleeve of the anilox roller 22, if necessary.

Thus, the conversion of the ink unit 16 for the new print job may be accomplished before the previous print job has ended, so that the new print job can be started without loss of time. When the ink unit 16 has to be made operative again, the safeguard 40 is withdrawn into the inoperative position shown in FIGS. 1 and 2, and the plate cylinder 20 and the anilox roller 22 are again adjusted against one another and against the central cylinder 14.

What is claimed is:

1. A method of exchanging a printing cylinder sleeve in a printing machine, which printing machine comprises a central cylinder and a plurality of ink units adapted to be adjusted against the central cylinder, each ink unit comprising a plate cylinder having a printing cylinder sleeve mounted on a mandrel, and a detachable bearing for supporting the mandrel, the method comprising the following steps, which are performed while the printing machine is running:

moving one said plate cylinder away from the central cylinder to such an extent that a space formed between said one plate cylinder and the central cylinder becomes large enough for gripping the printing cylinder sleeve of said one plate cylinder, bringing a safeguard into a position in which it shields a part of an end face and a part of the peripheral surface of the central cylinder facing the plate cylinder, detaching the bearing associated with said one plate cylinder, and withdrawing the printing cylinder sleeve of said one plate cylinder axially from the mandrel associated with said one plate cylinder.

2. Method according to claim 1, wherein said space formed between a peripheral surface of the printing cylinder sleeve associated with said one plate cylinder and a peripheral surface of the central cylinder has a width of at least 120 mm.

3. Printing machine comprising:

a frame a central cylinder, a plurality of ink units adapted to be adjusted against the central cylinder and each comprising a plate cylinder having a printing cylinder sleeve mounted on a mandrel and adapted to be withdrawn axially from the mandrel, and a plurality of safeguards mounted on the side of the printing machine to which each printing cylinder sleeve is withdrawn from the respective mandrel, each said safeguard shielding a portion of the central cylinder facing a respective plate cylinder, wherein each said the plate cylinder is movable away from the central cylinder to such an extent that a space formed between a peripheral surface of the printing cylinder sleeve and the respective safeguard becomes large enough to safely grip the respective printing cylinder sleeve at its periphery and to withdraw it from the respective mandrel.

4. Printing machine according to claim 3, wherein each safeguard is adjustably mounted to the machine frame.

5. Printing machine according to claim 4, wherein each safeguard has a shield plate extending essentially in parallel with a peripheral surface of the central cylinder, and the safeguard is adjustable in a direction in parallel with an axis of rotation of the central cylinder into an operative position in which the shield plate shields a part of the peripheral surface of the central cylinder.

6. Printing machine according to claim 5, wherein the machine frame has a side member in which a window is formed through which each printing cylinder sleeve can be withdrawn from the respective mandrel, and the respective safeguard is withdrawable into said window.

* * * * *